US007192190B2

(12) United States Patent
Jung

(10) Patent No.: US 7,192,190 B2
(45) Date of Patent: Mar. 20, 2007

(54) PLASTIC BAG HAVING FLAP CONSTRUCTION

(76) Inventor: Koock Elan Jung, 597 Bay Rd., Queensbury, NY (US) 12804

( * ) Notice: Subject to any disclaimer, the term of this patent is extended or adjusted under 35 U.S.C. 154(b) by 513 days.

(21) Appl. No.: 10/719,156

(22) Filed: Nov. 21, 2003

(65) Prior Publication Data

US 2005/0111763 A1 May 26, 2005

(51) Int. Cl.

| | |
|---|---|
| ***B65D 33/14*** | (2006.01) |
| ***B65D 33/00*** | (2006.01) |
| ***B65D 33/16*** | (2006.01) |
| ***A01K 29/00*** | (2006.01) |

(52) U.S. Cl. ..... 383/22; 383/33; 383/87; 294/1.4

(58) Field of Classification Search ..... 383/87, 383/22, 75, 33; 294/1.3–1.5
See application file for complete search history.

(56) References Cited

U.S. PATENT DOCUMENTS

| | | | | |
|---|---|---|---|---|
| 3,281,178 | A * | 10/1966 | Fisher | 294/1.4 |
| 3,309,007 | A * | 3/1967 | Rosenberg et al. | 383/9 |
| 3,510,052 | A * | 5/1970 | Ruda | 383/11 |
| 3,782,622 | A | 1/1974 | Montgomery | |
| 4,047,746 | A * | 9/1977 | Radowski | 294/1.4 |
| 4,257,635 | A * | 3/1981 | Mainprice | 294/1.4 |
| 4,257,636 | A * | 3/1981 | Mainprice | 294/1.4 |
| 4,332,347 | A | 6/1982 | Clayton | |
| 4,709,851 | A | 12/1987 | Vanasse | |
| 4,846,586 | A | 7/1989 | Bruno | |
| 5,026,174 | A | 6/1991 | Blatt | |
| 5,464,285 | A | 11/1995 | Anderson | |
| 6,485,073 | B2 * | 11/2002 | Harrison | 294/1.4 |

* cited by examiner

*Primary Examiner*—Jes F. Pascua

(57) ABSTRACT

The invention sets forth a bag for an animal waste collection device. The bag is formed from a blank of plastic material, and comprises a middle section panel, a back panel, and a pocket front flap section. The bag defines a collection pocket formed by the front panel and back panel to accommodate waste collected from an animal waste collection device. The animal waste collection device collects animal waste from the bag at the pocket adapted to receive an animal waste collection device and the collection pocket accepts collected waste from the pocket adapted to receive an animal waste collection device.

15 Claims, 10 Drawing Sheets

PLASTIC BAG HAVING FLAP CONSTRUCTION

BACKGROUND OF THE INVENTION

The invention relates to plastic bags. In particular, the invention relates to plastic bags having a construction with a flap construction on both sides. The plastic bag is particularly useful on conjunction with an animal waste collection device that is used for collecting, storing, and disposing of the animal waste.

It has been said that the American population is outnumbered by their pets. Americans are thought to be outnumbered by our pet dogs alone, which may number more than 250 million by some estimates. As these pet numbers increase, the public demand for animal regulation increases correspondingly, responsive to the public health and safety concerns related to the high population of pet animals.

Generally, pet owners residing in municipal regions are subject to ordinances requiring that their animals be leashed at all times in public, and restrained in private to prevent uncontrolled wandering. Moreover, some municipalities, especially large cities have promulgated so-called "pooper-scooper" ordinances. These ordinances require pet owners to accept personal responsibility for collection and disposition of the waste material produced by their pet animals. A typical ordinance instituted recently provides that to avoid criminal charges, you must immediately place the waste in a plastic bag, securely tied, and then place it in a solid waste container. The enforcement of some ordinance specifies fines, jail time, and probation as penalty for violation.

When pet owners are subject to both leash-laws and pooper-scooper ordinances, the owner is obliged to (a) "walk" their pet on a leash and (b) retrieve and dispose of pet wastes when and where the animal decides to relieve itself. This distasteful routine is all too familiar to all responsible dog owners and many bystanders. Because of the distastefulness of this routine, less responsible dog owners may leave the waste where it lies. A local legislative body may respond to this problem by instituting severe sanctions for such behavior, such as the type of penalties exemplified above. Practitioners in the art respond to the problem by proposing means designed to minimize the unpleasantness of the gathering and disposal of such animal waste.

For instance, the term "pooper-scooper" originally denominated a long-handled mechanical apparatus, well-known in the art. A pooper-scooper is used for retrieving dog wastes without soiling the owners' hands. Unfortunately, the first such pooper-scoopers were large and awkwardly-configured devices that were inconvenient to carry and often soiled in use. In using this or later versions and designs of pooper-scoopers, a rigid tray or scoop is employed to scoop up the waste material as best as possible. This design often soiled both the vicinity of the waste and the tray itself. Further, this design and others often require use of both hands, which is extremely difficult when holding a pet's leash.

Even if a disposable bag is placed within the tray, few means are provided for cleanly gathering all of the waste material into the bag. This omission usually obliges the user to employ a twig, branch, or other readily-available item as a tool or scraper for manipulating the waste material from its lying position into the bag.

Responsive to this problem, it has been proposed to add a spring-loaded clip to the bottom of a scoop for retaining a disposable plastic bag in position while "scooping" the waste material. While such an improvement may assist in solving the problem of holding the disposable bag in position for use, it may not do anything to improve the gathering operation. The user may still be obliged to grab the nearest twig or other suitable disposable scraper to gather the material into the bag. As every pet owner knows, a simple unaided scooping action relying on collection by gravity alone is not sufficient to gather and retain looser material into a bag held only on one side.

Accordingly, pet-owners (and others) are often confronted with pet waste that can be collected using only an awkward scoop or shovel or, worse, a simple plastic bag for use together with whatever other "tools" may be afforded by their immediate environment. Human nature being what it is, such unpleasant pet waste is commonly left where it lies, creating social, public-health, and legal problems for the pet owner and others. Other solutions known in the art such as, but not limited to, disposable surgical gloves, paper tissues, sandwich bags and the like do little to reduce the well-known unpleasantness of the pet sanitation task. None of these alternatives provides for simple sanitary gathering and bagging of pet waste.

One known bag related "pooper-scooper" is disclosed in Jung (the instant inventor), U.S. Pat. No. 6,237,972, entitled "Animal Waste Collection Device" the entire contents of which are fully incorporated herein by reference. The bag of Jung '972 receives and stores animal waste. The Jung '972 bag comprises a closed and open end and a slot that is complementary to the slot-like aperture where the open end of the bag is complementary to the elongated cylindrical member. The open end of the bag can be secured to one end of an elongated cylindrical member of the Animal Waste Collection Device and a closure member of the Animal Waste Collection Device provides access to the interior of the bag when an actuator assembly moves the closure member to an open position for collecting waste.

SUMMARY OF THE INVENTION

An aspect of the invention sets forth a bag made from a plastic material. The bag is formed from a blank of material. The bag comprises a middle section panel, a back panel, and a pocket front flap section. The middle section panel comprises a front panel and a rear panel, and the front panel is positioned generally adjacent the back panel, so the front panel and the back panel are positioned generally coextensive when the blank is bent at upper fold line to define the bag. The rear panel is generally adjacent the pocket front flap section so the rear panel and the pocket front flap section are positioned generally coextensive when the blank is bent at a fold line to define an opening. The opening, fold line for pocket front flap, pocket front flap section, and rear panel define a pocket adapted to receive an animal waste collection device. The back panel and the front panel are generally adjacent each other with a lower fold line positioned therebetween. Thus, the front panel and back panel are positioned generally coextensive with each other when the blank is bent at a fold line to define a waste opening. The waste opening, fold line, front panel, and back panel define a collection pocket formed by the front panel and back panel to accommodate waste collected from an animal waste collection device. The bag defines edges that comprise seal lines, so an edge of the back panel is sealed to an edge of the middle section. The edge of the middle section is in general proximity to the back panel. An edge of the back panel, which is opposite the edge of the middle section that is in general proximity to the back panel edge, is sealed to an edge of middle section, so the edge of middle section, which is opposite the edge of the middle section that is in general proximity to the back panel edge, is in general proximity to the back panel. The pocket front flap section comprises a line of weakness that divides the pocket front flap section. The line of weakness is adapted to accommodate an animal waste collection device that used in conjunction with the bag. The animal waste collection device collects animal waste from the bag at the pocket adapted to receive an animal waste collection device and the collection pocket accepts collected waste from the pocket adapted to receive an animal waste collection device.

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

Figure 8:
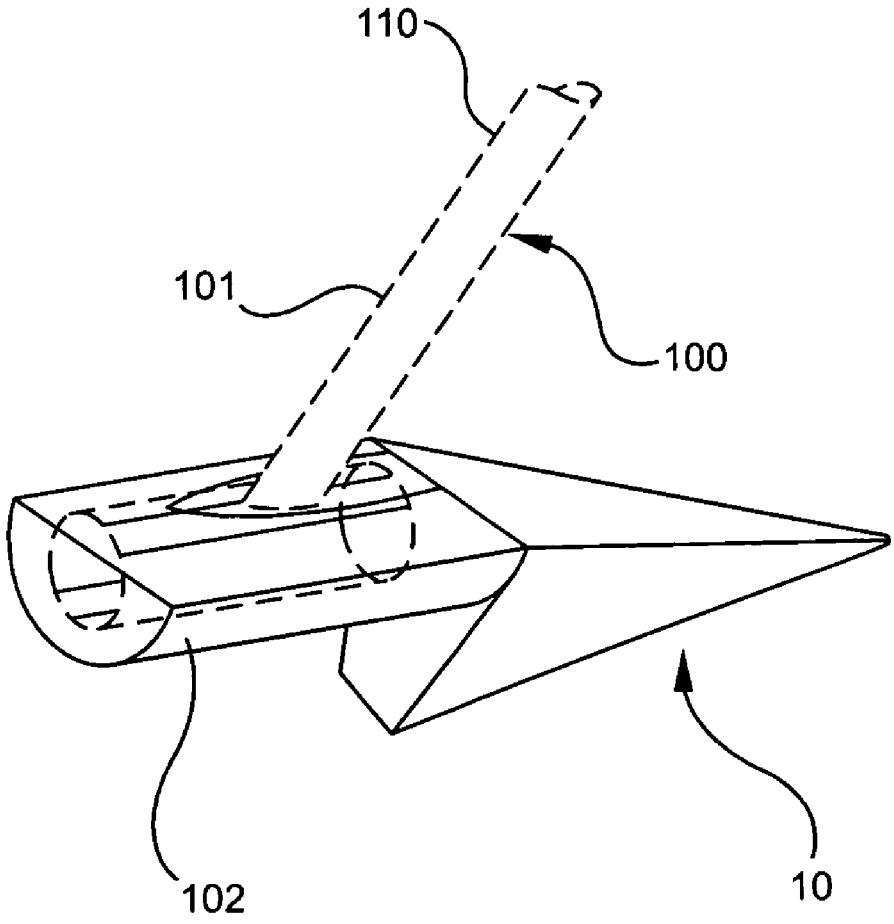
FIG. 8 is a schematic illustration of the plastic bag, as embodied by the invention, in combination with an animal waste collection device.

FIGS. 1–4 illustrate a plastic bag 10, as embodied by the invention. The plastic bag 10 is intended for use with an animal waste collection device 100, as illustrated in FIG. 8, to be described hereinafter.

The bag 10 is, for example, made of a flexible material, such as plastic film and, more particularly, polyethylene or polypropylene film having a thickness of, for example, from about 0.0005 to 0.20 inches. The above materials are mentioned by way of example only as the bags 10, as embodied by the invention. The bag 10, as embodied by the invention, may be fabricated from other materials, such as both natural and synthetic, and including, but not limited to, materials such as paper, cloth, foil, and the like, which can be plasticized and shape-retentive. The above descriptions of materials fore the bag 10, as embodied by the invention, are intended to be exemplary only and not intended to limit the invention, as embodied by the invention, in any manner.

Figure 1:
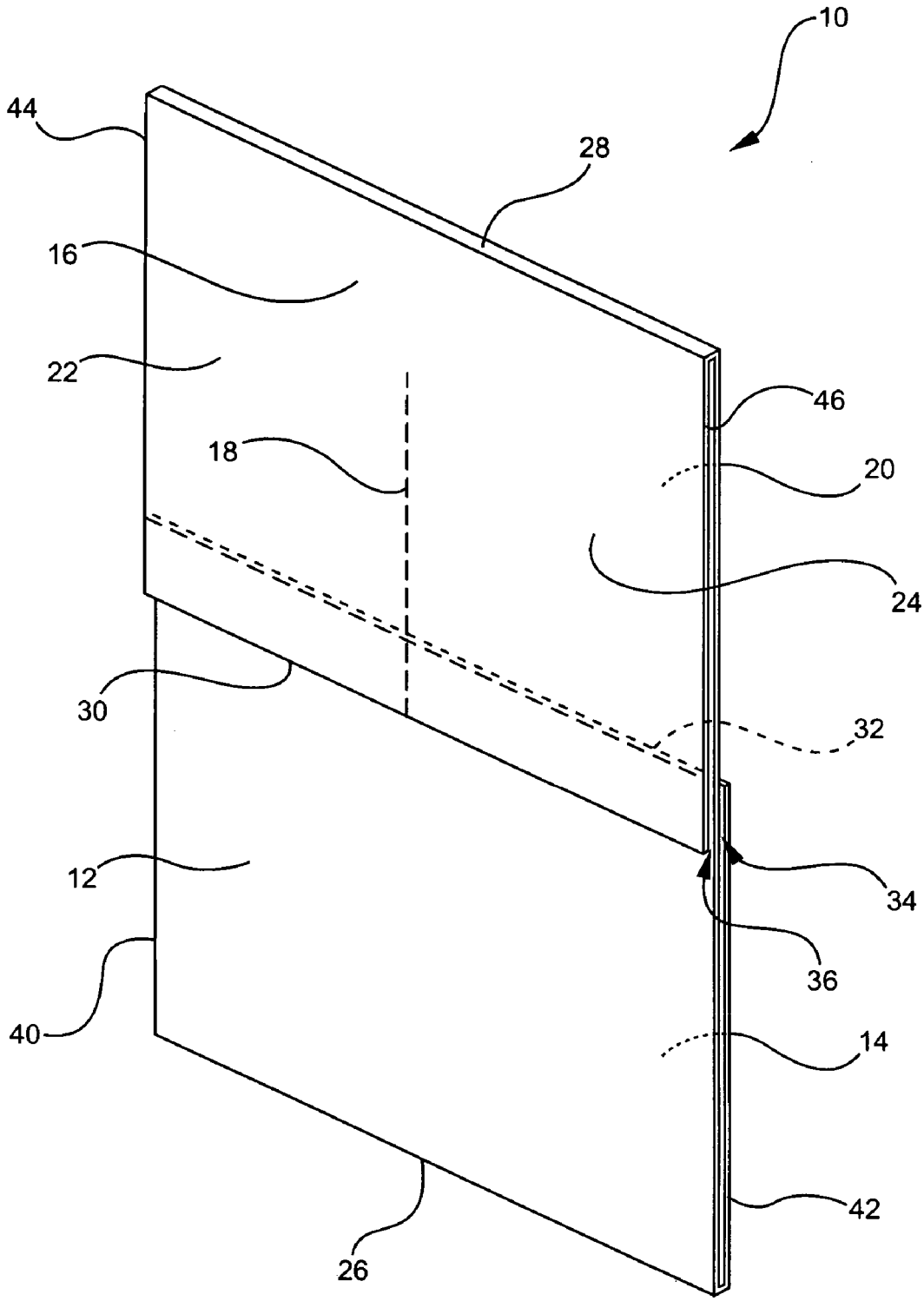
FIG. 1 is a side elevational illustration of a plastic bag, as embodied by the invention.
Figure 2:
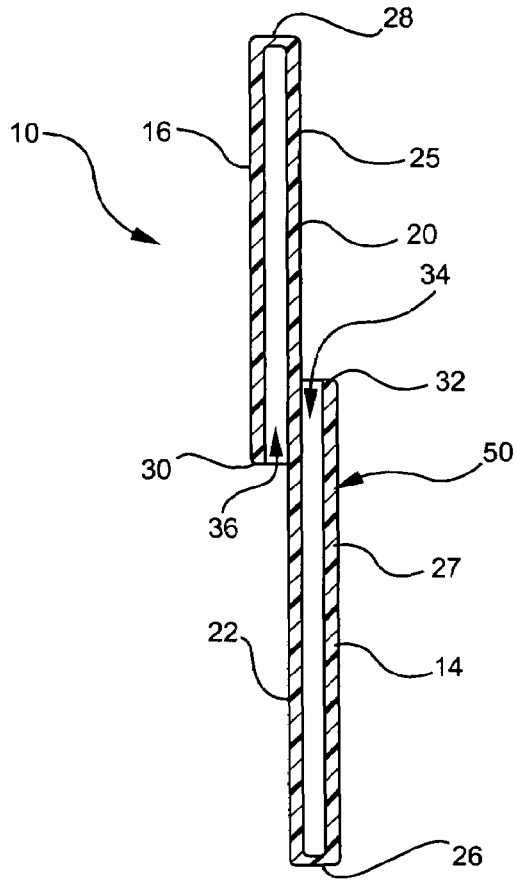
FIG. 2 is a side sectional illustration of the plastic bag, as embodied by the invention.
Figure 3:
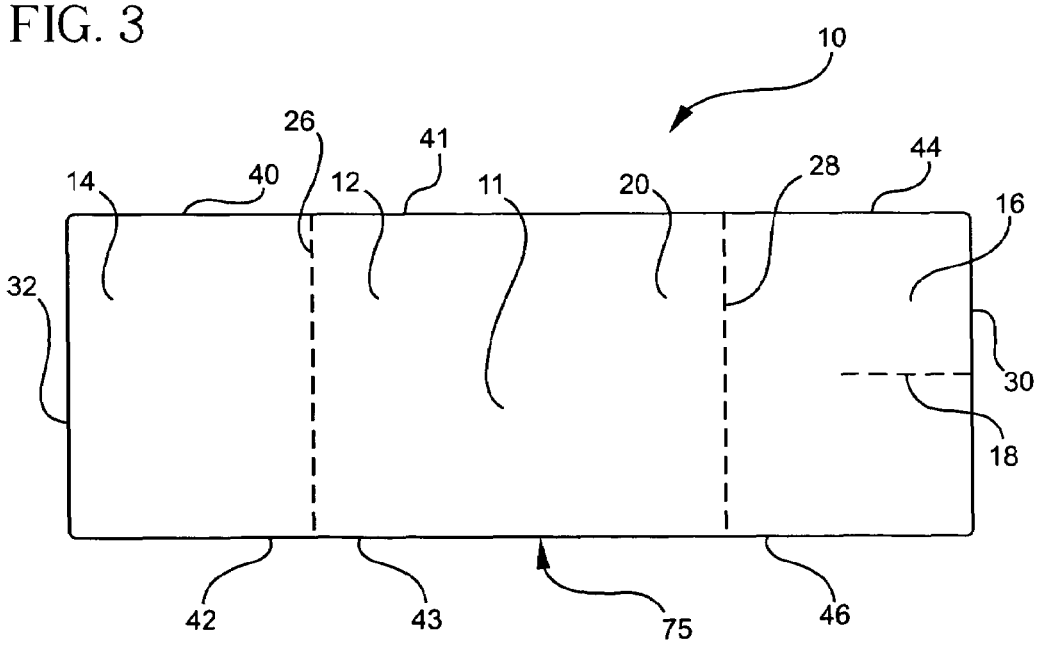
FIG. 3 is planar sheet stock of material from which the bag, as embodied by the invention, can be constructed.

With reference to FIGS. 1–3, the bag 10 is generally formed from a rectangular blank of material 75 (FIG. 3). For ease of description, the bag 10 will be described as formed from a plastic material, however, as noted above, this material description is merely exemplary and is not intended to limit the invention in any manner.

The bag 10 comprises a first three general sections, a middle section panel 11, a back panel 14, and a pocket front flap section 16 for an animal waste collection device 100 (as described hereinafter). The designations of front, middle, bag, and the like are m merely for ease of description and are not intended to limit the invention in any manner. The middle section panel 11 comprises a front panel 12 and a rear panel 20. The front panel 12 is adjacent the back panel 14 so as to be positioned substantially coextensive with each other when the stock 75 is bent at upper fold line 28 for pocket front flap. Thus, the front panel 12 and back panel 14 are formed into the bag 10, as embodied by the invention (see FIG. 2).

Further, the rear panel 20 is adjacent the pocket front flap section 16 so as to be positioned substantially coextensive with each other when the stock 75 is bent at lower fold line 26 to define an opening 36. Thus, the opening 36, upper fold line for pocket front flap. 28, pocket front flap section 16, and rear panel 20 define a pocket 25. The pocket 25 formed by the pocket front flap section 16 and the rear panel 20 will accommodate the animal waste collection device 100. See FIG. 8.

Figure 5:
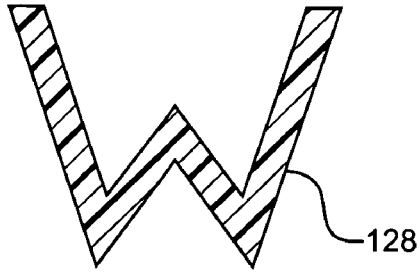
FIG. 5 is a schematic illustration of the plastic bag, as embodied by the invention, with a "W" shaped fold line, as embodied by the invention.

The upper fold line 28 for pocket front flap, as embodied by the invention, can comprise any fold line construction, as long as the fold line construction enables an opening 36 for the bag 10 to be formed. The upper fold line 28 for pocket front flap, as embodied by the invention, is illustrated in FIG. 2 as a "U" shaped upper fold line 28 for pocket front flap. However, this configuration of the upper fold line 28 for pocket front flap is merely exemplary of any fold line construction that would enable a pocket 25 to be defined in the bag 10, as embodied by the invention. For example, and in no way limiting of the invention, a "W" shaped fold line 128 (FIG. 5), may be used as a fold construction for the bag 10, as embodied by the invention. The details of a "W" shaped fold line 126 are well known in the art and details to the same are omitted.

The back panel 14 and the front panel 12 are adjacent each other with a lower fold line 26 positioned therebetween. Thus, front panel 12 and back panel 14 are positioned substantially coextensive with each other when the stock 75 is bent at lower fold line 26 to define a waste opening 34. Thus, the opening 34, lower fold line 26, front panel 12, and back panel 14 define a collection pocket 27. The collection pocket 27 that is formed by the front panel 12 and back panel 14 will accommodate feces collected from the animal waste collection device 100, as described hereinafter. See FIG. 8.

As with the upper fold line 28 for pocket front flap, the lower fold line 26 can comprise any fold line construction, as long as the fold line construction forms form an opening 34 for the bag 10. The lower fold line 26, as embodied by the invention, is illustrated in FIG. 2 as a "U" shaped lower fold line 26. However, this configuration of the lower fold line 26 is merely exemplary of any fold line construction that would enable a pocket 25 to be defined in the bag 10, as embodied by the invention. For example, and in no way limiting of the invention, a "W" shaped fold line similar to the "W" shaped fold line 126 (FIG. 5), may be used as a fold construction for the lower fold line 26, as embodied by the invention.

Figure 4:
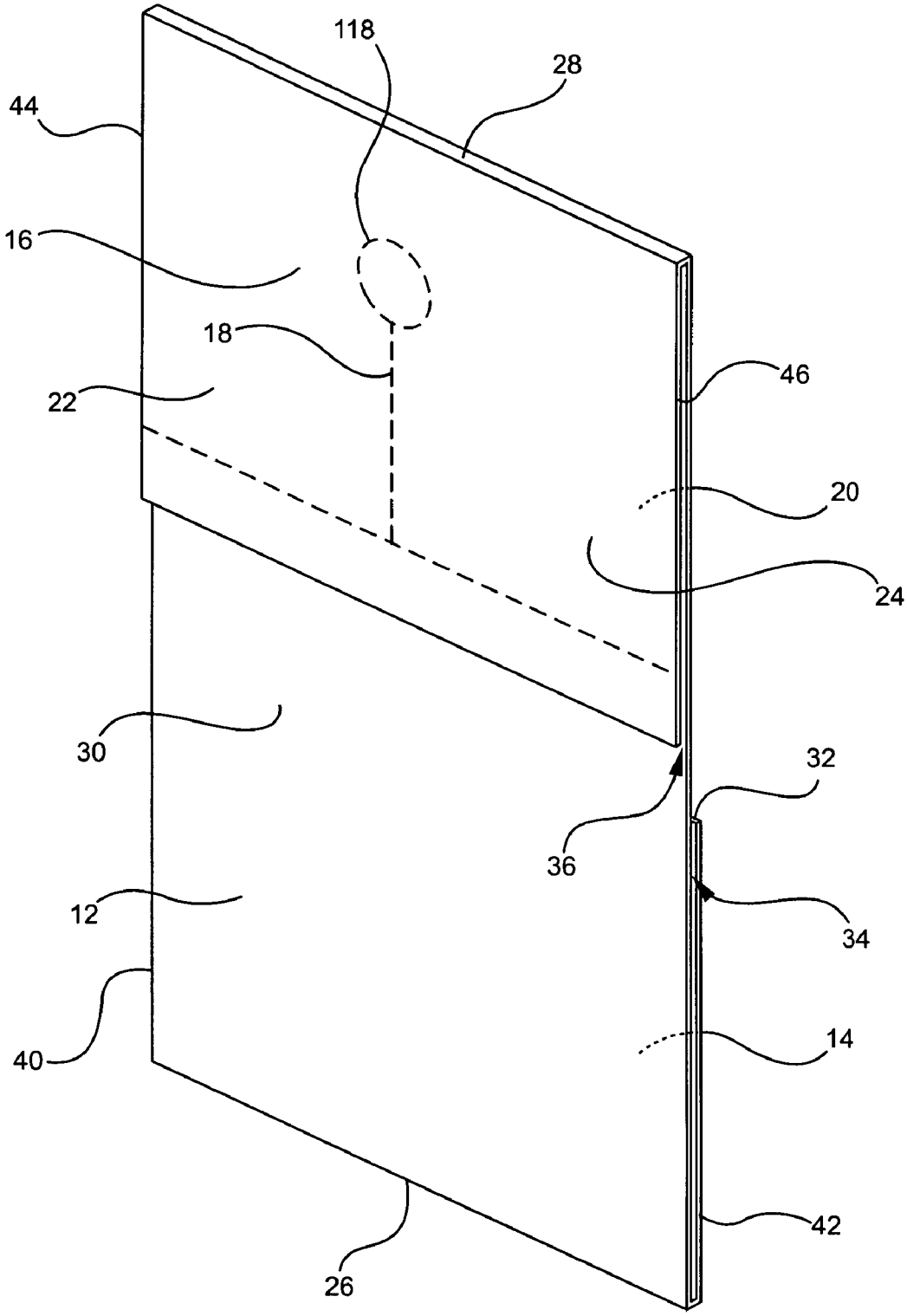
FIG. 4 is a side elevational illustration of a further plastic bag, as embodied by the invention.

The pocket front flap section 16 for an animal waste collection device 100 comprises a line of weakness 18, as illustrated in FIGS. 1, 3, and 4. The line of weakness 18 accommodates a portion of an animal waste collection device 100 when the animal waste collection device 100 is used in conjunction with the bag 10. The line of weakness 18 divides the pocket front flap section 16 into a side 22 of pocket front flap section 16 and aside of pocket front flap 24.

The line of weakness 18, as embodied by the invention, can comprise a line of weakness pattern formed by perforations. The perforations can comprise elongated slot perforations, aligned hole perforations, or combinations thereof. The exact structure and makeup of the line of weakness 18 can comprise any appropriate structure as long as the function of the line of weakness 18, as described hereinafter, is accomplished.

The line of weakness 18, as embodied by the invention, defines a substantially linear pattern (FIGS. 1 and 3). Alternatively, the line of weakness 18 can be formed with an apertured line of weakness 118. The apertured line of weakness 118 can be formed in a circular fashion, as illustrated in FIG. 4, or any other apertured shape.

The line of weakness 18 can be selectively opened or separated by a tearing or opening force (hereinafter "force") applied by a user of the bag 10. The user starts to apply a force to the line of weakness 18 at edge 30. The force, or any other appropriate force applied to the line of weakness 18, causes the perforations on the 18 to separate. The separation can continue as long as the force is applied by a user and as long as perforations along the line of weakness 18 are still unseparated.

The line of weakness 18 is provided in the bag 10 and is dimensioned to permit the material of the bag 10 to be opened or separated along the line of weakness 18. This opening along the line of weakness 18 forms the side of pocket front flaps 22 and 24.

Alternatively the apertured line of weakness 118 can be included in the bag 10. The apertured line of weakness 118 forms an opening in the bag 10 at the terminal end of the line of weakness 18 at the opposite end of the 18 from it start at edge 30. If an apertured line of weakness 118 is used with the bag 10, as embodied by the invention, the animal waste collection device 100 can extend through the formed aperture. If the apertured line of weakness 118 is not used with the bag 10 and a line of weakness 18, as embodied by the invention, is used with an animal waste collection device 100

Edges of the bag 10 are preferably seal lines, which are formed during the manufacture of the bag 10. Before sealing, there are adjacent bags attached along edges 20 and 22. Sealing of the edges can be accomplished in any conventional manner during the bag 10 manufacturing process. Edge 40 of the back panel 14 is sealed to a portion of the edge 41 of middle section 11, wherein that portion of the edge 41 is in closest proximity to back panel 14. Further, the opposite edge 42 of the back panel 14 is sealed to a portion of the edge 43 of middle section 11, wherein that portion of the edge 43 is in closest proximity to back panel 14. See FIG. 2.

Conversely, as also illustrated in FIG. 2, edge 44 of the pocket front flap section 16 is sealed to a portion of the edge 41 of middle section 11, wherein that portion of the edge 44 is in closest proximity to pocket front flap section 16. Furthermore, the opposite edge 46 of the pocket front flap section 16 is sealed to a portion of the edge 43 of middle section 11, wherein that portion of the edge 43 is in closest proximity to pocket front flap section 16.

Figure 6:
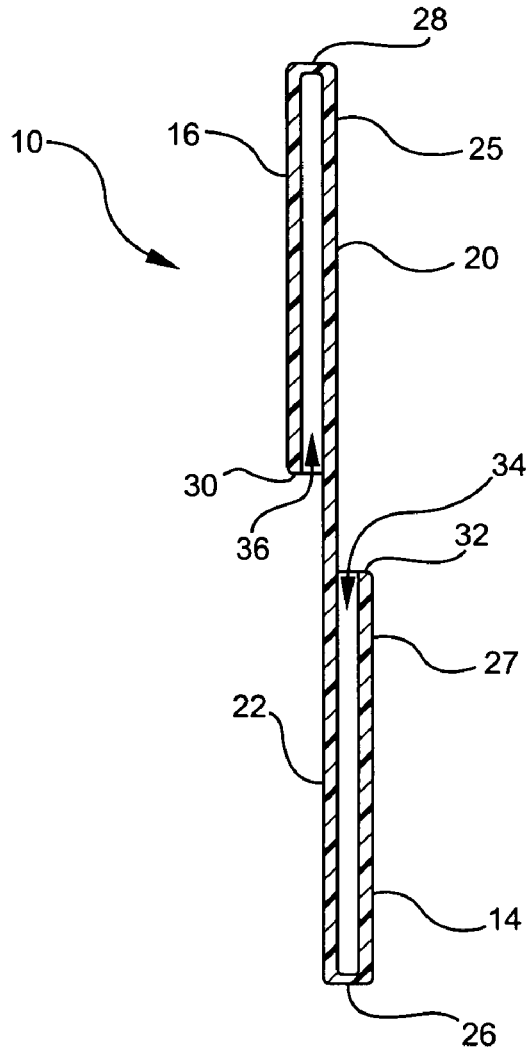
FIG. 6 is a schematic illustration of the plastic bag, as embodied by the invention, in accordance with another aspect of the invention.

The pockets 25 and 27 of the bag 10, as embodied by the invention, can be formed in any convenient relationship with each other. For example, and in no way limiting of the invention, as illustrated in FIG. 2, the edges 30 and 32 of the pockets 25 and 27 "overlap" each other to have a coextensive portion 50. Alternatively, the edges 30 and 32 of the pockets 25 and 27 of the bag 10, as embodied by the invention, can be formed to end short of each other, as illustrated in FIG. 6.

The sealing of the edges can be accomplished in any conventional manner during the bag 10 manufacturing process: For example and in no way limiting of the invention, the sealing of the edges of the bag 10, as embodied by the invention, can be heat-sealed, glued, taped, or otherwise connected to each other in a way to hold and contain feces from an animal waste collection device 100.

Figure 6A:
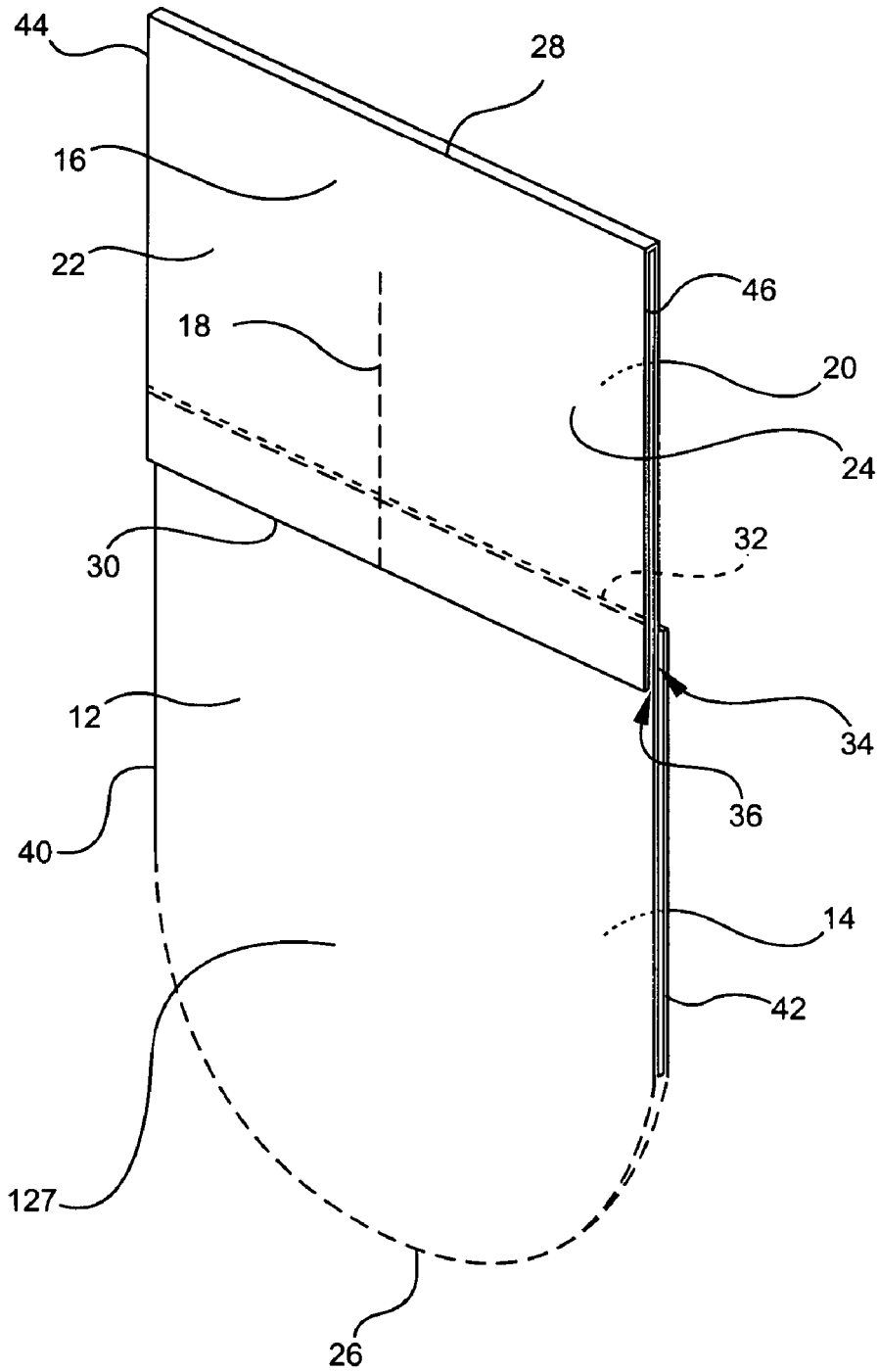
FIG. 6A is a schematic illustration of the plastic bag, as embodied by the invention, in accordance with another aspect of the invention.

The bag 10, as embodied by the invention, can comprise any convenient and desirable shape, as long as the bag 10 can hold and contain feces from an animal waste collection device 100. The bag 10 is illustrated in a generally rectangular form. This form is merely exemplary of the shape of a bag 10, as embodied by the invention. Further, the bag 10, can comprise a non-rectangularly, arcuately shaped collection pocket 127, as illustrated in FIG. 6A.

Figure 7:
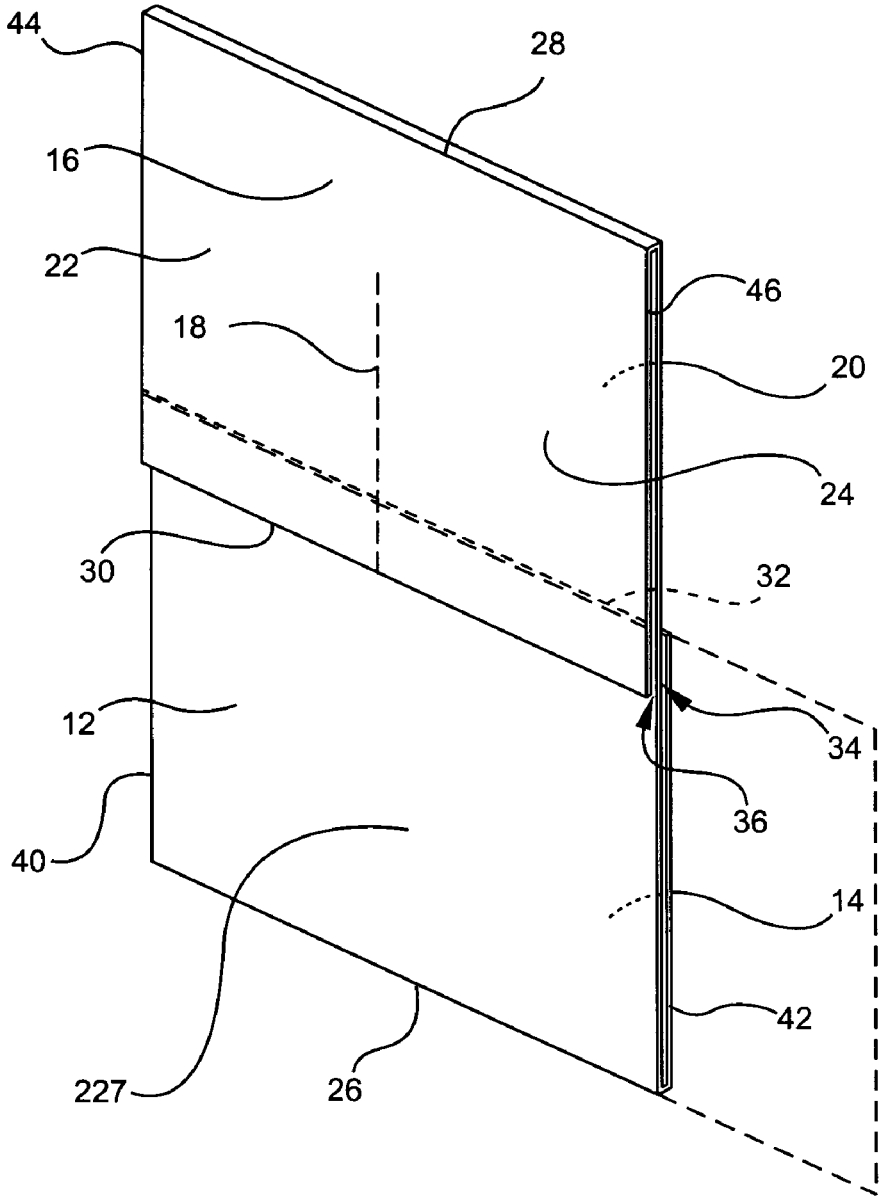
FIG. 7 is a schematic illustration of the plastic bag, as embodied by the invention, in accordance with yet another aspect of the invention.

In another facet of the invention, the bag 10 can comprise an oversized collection pocket 227, as illustrated in FIG. 7. The oversized collection pocket 227 is larger to accommodate a larger amount of feces collected by the user of the animal waste collection device 100. The oversized collection pocket 227 can be formed in a similar manner, as is the bag 10, as described above. The blank 75 can be formed with the oversized collection pocket 227 formed therewith and sealed in a manner consistent with the above description.

FIG. 8 illustrates the cooperation of a bag 10, as embodied by the invention, with an animal waste collection device 100. The cooperation of bag 10 as used with the animal waste collection device 100 will now be described. The description of the animal waste collection device 100 is merely exemplary and is not intended to limit the invention in any manner. Any animal waste collection device can be used with the bag 10, as embodied by the invention, if they cooperate in structure and function.

The bag 10 is placed on the animal waste collection device 100 in the following manner. The user opens the line of weakness 18 to a degree sufficient to insert the handle 101 of the animal waste collection device 100 between the sides of pocket front flap for animal waste collection device 22 and 24. The rear panel 20 is then introduced into the animal waste collection device 100, for example the animal waste collection device, as in U.S. Pat. No. 6,237,972, entitled "Animal Waste Collection Device". The rear panel 20 encircles the collection means of the animal waste collection device 100 so the collection means of the animal waste collection device 100 do not get soiled. See U.S. Pat. No. 6,237,972, entitled "Animal Waste Collection Device". In this position, the bag 10, as embodied by the invention, has the collection pocket 27 unsupported from the animal waste collection device 100, converse to the pocket 25 that is directed supported by an animal waste collection device 100.

The user of the animal waste collection device 100 with the bag 10, as embodied by the invention, will collect feces by opening the animal waste collection device 100 and encircling the feces. The collection means of the animal waste collection device 100 will then encircle and contain the feces within the bag 10 at the rear panel 20. The user will then move the bag 10 and animal waste collection device 100 in the direction of arrow 110 so that the collection pocket 27 is disposed below the animal waste collection device 100 and the feces contained therein. The feces can then drop into the 27, either under the force of gravity or by a gentle shaking, or a combination of both. In addition, the user may open the collection means of the 100 to assist in the movement of the feces into the collection pocket 27 from the area of the bag 10, proximate the rear panel 20.

A user can remove the bag 10, as embodied by the invention, by simply sliding the bag 10 and the animal waste collection device 100 in opposite directions from each other. Alternatively, the sides of pocket front flap for animal waste collection device 22 and 24 can be inverted over the upper fold line for pocket front flap 28 to remove the bag 10, as embodied by the invention, from the 100. In whatever manner the user of the bag 10 and animal waste collection device 100 removes the bag 10 from the animal waste collection device 100 neither the animal waste collection device 100 nor the user will get soiled from the feces that has been collected.

The above description of use and operation of the bag 10 in conjunction with an animal waste collection device 100 are merely exemplary of the invention. This description is not intended to limit the invention in any manner and alternative uses of the bag 10 are within the scope of the invention.

Figure 9:
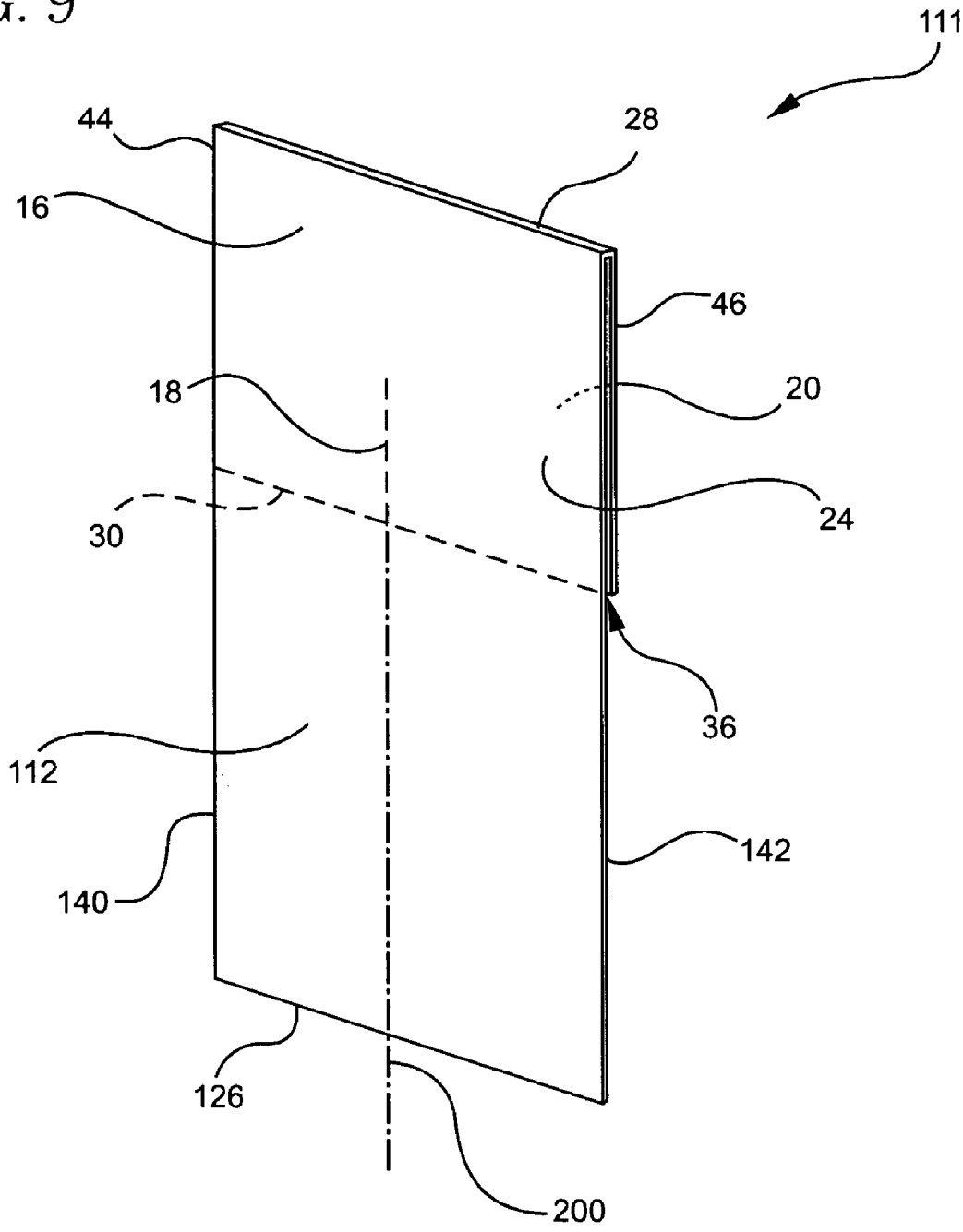
FIG. 9 is a schematic illustration of the plastic bag, as embodied by the invention, in accordance with still another aspect of the invention.
Figure 10:
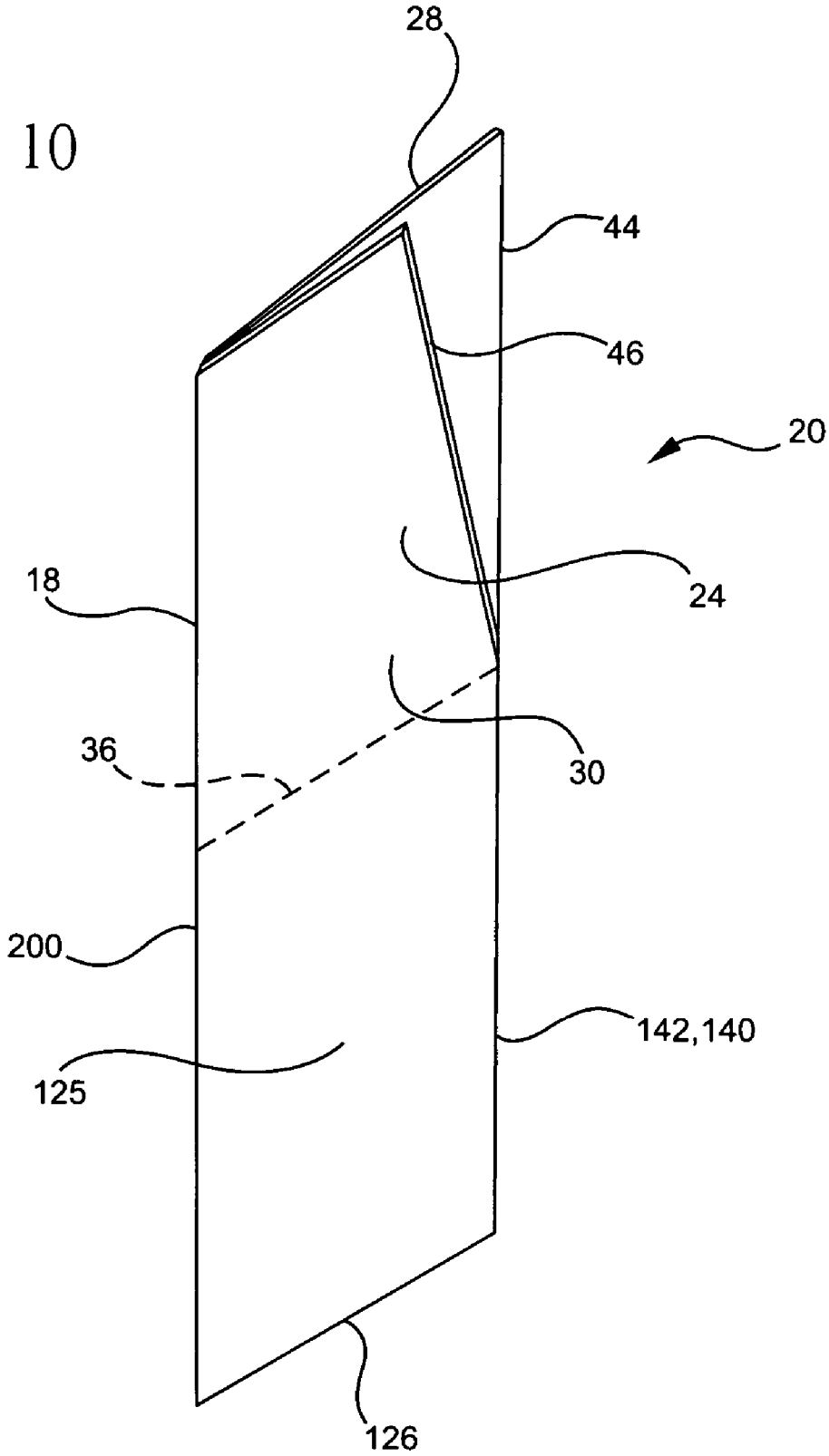
FIG. 10 is a schematic illustration of the plastic bag, as embodied in FIG. 9, with the lower edge and sides of bag blank adhered together to form a collection portion.
Figure 11:
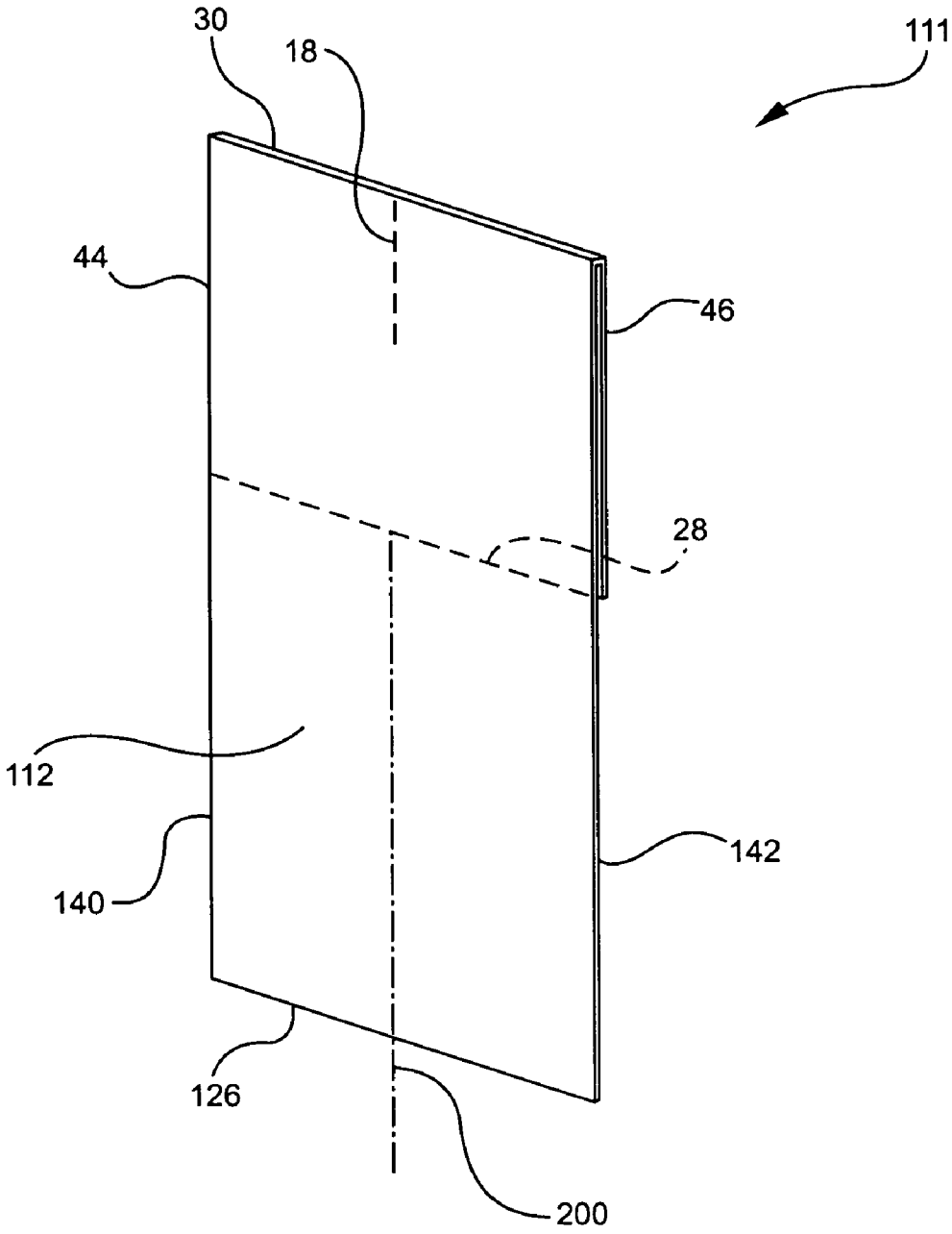
FIG. 11 is a planar sheet stock of material from which the plastic bag, as embodied in FIG. 9, can be formed.

Another embodiment of the invention is illustrated in FIGS. 9–11. The plastic bag 111 is similar in material and other aspects as the bag 10, as described above. Similar elements are labeled with like reference numbers and reference to the above description of the bag 10 can be made for a detailed description of the invention.

The top portion of the bag 111 is essentially similar in form and configuration as the bag 10. Thus, a further description of the top portion of the bag 10, which receives and cooperates with the animal waste collection device, will be omitted for clarity and brevity purposes.

The bag 111, as embodied by the invention, forms a collection pocket 125 by folding a bottom panel 112 of the blank for the bag 111 (FIG. 11) about a centerline 120, which is illustrated by a dashed and dotted line in FIGS. 9 and 11. The sides 140 and 142 of bag blank 111 are folded around the centerline 120 and brought into contact with each other. The lower edge 126 of the blank for the bag 111 is brought onto itself around centerline 120 so the sides 140 and 142 are coextensive with each other.

Edges 140 and 142 of the bag 11, as well as the lower edge 126 are adhered to each other by any conventional means. For example, and in no way limiting of the invention, the edges 140 and 142 of the bag 111, as well as the lower edge 126, can be sealed to each other. Alternatively, edges 140 and 142 of the bag 111, as well as the lower edge 126 can be glued to each other, stapled, or any other type of adherence. Sealing of the edges can be accomplished in any manner during the bag 111 manufacturing process.

By adhering the edges 140 and 142 of the bag 111, as well as the lower edge 126, a pocket 125 is formed in the bag 111. with use of the bag 111 having the animal waste collection device inserted into the line of weakness 18 for animal waste collection device, the animal waste collection device may grab animal in manner described above and as embodied by the invention. Opening of the animal waste collection device will allow the animal waste to fall, as described above into the pocket 125. The waste can then be properly disposed of without soiling the user of the animal waste collection device or the animal waste collection device itself.

While embodiments of the invention have been described, the present invention is capable of variation and modification, and therefore should not be limited to the description herein. The invention includes changes and alterations that fall within the purview of the following claims. Individual components of the described and illustrated embodiments may be used interchangeably with each other component of the described and illustrated embodiments.

What is claimed:

1. A bag made from a plastic material, the bag formed from a blank of material, the bag comprising:

a middle section panel, a back panel, and a pocket front flap section, the middle section panel comprising a front panel and a rear panel, the front panel being positioned generally adjacent the back panel so the front panel and the back panel are positioned generally coextensive when the blank is bent at upper fold line to define the bag, the rear panel being generally adjacent the pocket front flap section so the rear panel and the pocket front flap section are positioned generally coextensive when the blank is bent at a fold line to define an opening, the opening, fold line for pocket front flap, pocket front flap section, and rear panel define a pocket adapted to receive an animal waste collection device;

the back panel and the front panel being generally adjacent each other with a lower fold line positioned therebetween, so the front panel and back panel are positioned generally coextensive with each other when the blank is bent at a fold line to define a waste opening;

the waste opening, fold line, front panel, and back panel define a collection pocket formed by the front panel and back panel to accommodate waste that is collected from an animal waste collection device;

the bag defining edges that comprise seal lines, an edge of the back panel being sealed to an edge of the middle section, wherein the edge of the middle section is in general proximity to the back panel, and an edge of the back panel, which is opposite the edge of the middle section that is in general proximity to the back panel edge, being sealed to an edge of middle section, so the edge of middle section, which is opposite the edge of the middle section that is in general proximity to the back panel edge, is in general proximity to the back panel; and the pocket front flap section comprises a line of weakness, the line of weakness extending from a free edge of the pocket front flap section and terminating prior to the upper fold line, the line of weakness divides the pocket front flap section; and wherein the line of weakness is adapted to accommodate an animal waste collection device that used in conjunction with the bag, and the animal waste collection device collects animal waste from the bag at the pocket adapted to receive an animal waste collection device and the collection pocket accepts collected waste from the pocket adapted to receive an animal waste collection device.

2. A bag according to claim 1, wherein the seal lines comprise heat seal lines.

3. A bag according to claim 1, wherein the seal lines comprise adhesive seal lines.

4. A bag according to claim 1, wherein at least one of said fold lines comprises "U" shaped upper line.

5. A bag according to claim 1, wherein at least one of said fold lines comprises "W" shaped upper line.

6. A bag according to claim 1, wherein the line of weakness comprises perforations.

7. A bag according to claim 6, wherein the line of weakness comprises an apertured line of weakness.

8. A bag according to claim 1, wherein edges of the pocket adapted to receive an animal waste collection device and the collection pocket formed by the front panel and back panel to accommodate waste collected from an animal waste collection device overlap each other defining coextensive portion.

9. A bag according to claim 1, wherein edges of the pocket adapted to receive an animal waste collection device and the collection pocket formed by the front panel and back panel to accommodate waste collected from an animal waste collection device end short of each other where one pocket is larger than the other pocket.

10. A bag according to claim 1, wherein the bag is generally rectangular.

11. A bag according to claim 1, wherein the bag comprises an arcuate portion.

12. A bag according to claim 1, further wherein the collection pocket formed by the front panel and back panel to accommodate waste collected from an animal waste collection device is larger than the pocket adapted to receive an animal waste collection device.

13. A bag according to claim 1, wherein the edges are adhered to each other.

14. A bag according to claim 1, wherein the edges are adhered to each other by heat-sealing.

15. A bag according to claim 1, wherein edges are adhered to each other by adhesive.

* * * * *